US008814166B1

(12) United States Patent
Nizgoda

(10) Patent No.: US 8,814,166 B1
(45) Date of Patent: Aug. 26, 2014

(54) METHOD, SYSTEM, AND DEVICE FOR CONDUCTING A GAME

(71) Applicant: David Nizgoda, Las Vegas, NV (US)

(72) Inventor: David Nizgoda, Las Vegas, NV (US)

(73) Assignee: Casino War Blackjack, Inc., Las Vegas, NV (US)

( * ) Notice: Subject to any disclaimer, the term of this patent is extended or adjusted under 35 U.S.C. 154(b) by 0 days.

(21) Appl. No.: 14/093,868

(22) Filed: Dec. 2, 2013

Related U.S. Application Data

(60) Provisional application No. 61/854,944, filed on May 6, 2013.

(51) Int. Cl.
*A63F 1/00* (2006.01)
*G07F 17/32* (2006.01)
*A63F 3/00* (2006.01)

(52) U.S. Cl.
CPC ..... *G07F 17/3293* (2013.01); *A63F 2001/003* (2013.01); *A63F 3/00157* (2013.01); *A63F 1/00* (2013.01)
USPC ..... 273/292; 273/274; 463/12

(58) Field of Classification Search
CPC . A63F 1/00; A63F 2001/003; A63F 3/00157; G07F 17/3293
USPC ..... 273/292, 274, 309; 463/12, 13
See application file for complete search history.

(56) References Cited

U.S. PATENT DOCUMENTS

| | | | | |
|---|---|---|---|---|
| 5,265,882 | A * | 11/1993 | Malek | 273/292 |
| 5,324,041 | A | 6/1994 | Boylan et al. | |
| 5,988,643 | A * | 11/1999 | Awada | 273/292 |
| 6,692,003 | B2 | 2/2004 | Potter et al. | |
| 2002/0113371 | A1 * | 8/2002 | Snow | 273/292 |
| 2003/0042679 | A1 * | 3/2003 | Snow | 273/292 |
| 2003/0207706 | A1 | 11/2003 | Potter et al. | |
| 2007/0155462 | A1 * | 7/2007 | O'Halloran et al. | 463/16 |
| 2008/0303207 | A1 | 12/2008 | Snow | |

* cited by examiner

*Primary Examiner* — Benjamin Layno
(74) *Attorney, Agent, or Firm* — Robert Ryan Morishita; Morishita Law Firm, LLC

(57) ABSTRACT

A method, system, and device for conducting a game includes receiving a war base wager and a blackjack base wager. A player war hand and dealer war hand are dealt. The war base wager is resolved based on a comparison between the player war hand and dealer war hand. Optionally, the blackjack base wager may be supplemented by any war payout, or a portion thereof. An initial player blackjack hand and an initial dealer blackjack hand are dealt. Optionally, the initial player blackjack hand and/or initial dealer blackjack hand contain the player war hand and/or dealer war hand, respectively. Optionally, the blackjack base wager is resolved by forming a final player blackjack hand and a final dealer blackjack hand which are compared to one another and a target value.

7 Claims, 5 Drawing Sheets

METHOD, SYSTEM, AND DEVICE FOR CONDUCTING A GAME

RELATED APPLICATION DATA

The present application claims the priority of U.S. Provisional Application Ser. No. 61/854,944, entitled "Casino War Blackjack," filed May 6, 2013 by Applicant herein.

FIELD OF THE INVENTION

The present invention relates to methods, systems, and devices for conducting games. More particularly, the present invention includes methods, systems, and devices for conducting a casino game having a first stage in which a player war hand is compared to a dealer war hand to resolve a war base wager, and a second stage in which a player blackjack hand is compared to a dealer blackjack hand to resolve a blackjack base wager.

BACKGROUND OF THE INVENTION

Blackjack is a well-known card game conducted in casinos. The object of the game is to have a final hand total closer to twenty-one than the final dealer hand total is, without exceeding twenty-one. For purposes of calculating the final hand total, each card has a value equal to its face value except face cards, which have a value of ten, and Aces, which may have a value of eleven or one, depending on which forms the best hand. In conventional blackjack, the suit of the cards is irrelevant. A final hand total that exceeds twenty-one is said to "bust" and is considered a losing hand.

The form of blackjack conducted in casinos is banked by the house and is played between a dealer, representing the house, and at least one player. In a typical blackjack game, each player makes a base wager in a wagering area on a playing surface. The dealer deals an initial player hand containing two cards to each player and an initial dealer hand containing two cards to himself or herself. The two cards of the initial dealer hand may be dealt together, with one card face up and the other face down, or dealt separately, with a first card dealt before completing the players' hands and a second card dealt after completing the players' hands.

If the initial dealer hand does not have a natural twenty one, any initial player hand receiving a natural twenty-one or blackjack, i.e. a total of twenty-one in the initial dealt hand, is immediately rewarded, typically at a rate of 2:1, 3:2, or 6:5, and play is terminated as to that player. Each remaining player examines his or her initial player hand and decides whether to hit, i.e. receive another card, or stand, i.e. stop with the current hand. A player may hit as many times as the player wishes as long as the player does not bust, i.e. receive a card causing the cumulative sum of the values of the cards in the player's hand to exceed twenty-one. When a player busts, the player's wager is immediately collected and play is terminated as to that player.

A player may have additional options available depending on the initial player hand dealt. For example, a player may have the option to double down. Although the availability of the double down option vary from casino to casino, doubling down allows a player to double the player's wager in exchange for a single additional card dealt to the initial player hand. This option is typically selected when a player feels that he or she has a reasonable chance of winning by drawing only a single card. This is often the case when the player has an initial two-card total of ten or eleven, so that any ten-value card will give the player a total of twenty or twenty-one, or when the dealer has an exposed card of a five or six, and the player feels it likely that the dealer will bust.

A player may also have the option to split the initial player hand. Specifically, if the player receives a pair, i.e. two cards having the same card value, the player may split the pair and use each card as a basis for a separate hand. For example, if a player were to be dealt a pair of eights, the player may choose to split the pair and continue play with two separate hands each containing an eight and an additional dealt card. Each of the individual split hands is played independently, with the player free to hit or stand (or, possibly, split or double down depending on the house rules) the newly formed split hands.

After all the players have formed final hands, the dealer reveals the face-down card in the dealer hand. The dealer completes the dealer hand according to established house rules. That is, the casino uses established rules to eliminate discretion by the dealer in forming the dealer hand and the dealer hits or stands as the house rules dictate. The final dealer hand is compared to each final player hand and the target value of twenty one to resolve the wagers. In resolving the wagers, a player hand outranks or beats a dealer hand if the total sum of the cards in the player hand is closer to twenty-one than the total sum of the cards in the dealer hand is. For example, if the final dealer hand has a total sum of nineteen and a final player hand has a total sum of twenty, the final player hand "wins" because it is closer to the target value of twenty-one than the final dealer hand is. Wagers on winning player hands are typically rewarded at even money, i.e., 1:1. Wagers are collected from player hands with a final hand total further from twenty-one than the final hand total of the dealer hand is. If the dealer hand busts, all players who did not bust or receive a blackjack are rewarded. If the player and dealer push, i.e., have hands with the same final hand total, the player's wager is returned.

SUMMARY OF THE INVENTION

The present invention includes a method for conducting a game. The game may be conducted using physical playing cards, whether hand-dealt or dealt from an electronic device, such as a card shuffler or card shoe, which may include a random number generator to randomize the cards and/or an optical reader to discern the playing cards dealt. Alternatively or additionally, the game may be conducted using electronic representations of playing cards which may be stored in a data storage device and randomly selected by a data processor working cooperatively with a random number generator.

In one optional embodiment, a blackjack base wager and a war base wager are received. The sizes of the blackjack base wager and war base wager may be determined by table limits which fix the minimum, maximum, and/or relative proportion between the blackjack base wager and war base wager.

A player war hand consisting of a single playing card is dealt. Similarly, a dealer war hand consisting of a single playing card is dealt. The war base wager is resolved by comparing the player war hand to the dealer war hand and issuing a war payout based on the war base wager when the player war hand outranks the dealer war hand.

In an optional embodiment, an election is received to supplement the blackjack base wager with at least a portion of the war payout, if any. For example, in one optional embodiment, the blackjack base wager may be "capped" with all, or a portion, of the war payout, if any.

An initial player blackjack hand is dealt. In one optional embodiment, the initial player blackjack hand includes the player war hand. In an alternate optional embodiment, the player war hand is separate from the initial player blackjack hand, i.e., the initial player blackjack hand excludes the player war hand.

An initial dealer blackjack hand is dealt. In one optional embodiment, the initial dealer blackjack hand includes the dealer war hand. In an alternate optional embodiment, the dealer war hand is separate from the initial dealer blackjack hand, i.e., the initial dealer blackjack hand excludes the dealer war hand.

A final player blackjack hand is formed from the initial player blackjack hand by standing on the initial player blackjack hand or receiving at least one additional playing card dealt to the initial player blackjack hand. That is, in an optional embodiment, the basic actions provided in a conventional game of blackjack may be available, namely hit or stand. In an optional embodiment, the additional actions of splitting, doubling down, and/or surrendering may be available as well.

As in conventional blackjack, if the player blackjack hand busts, the blackjack base wager is collected and the game is terminated. More specifically, if the sum of the playing cards in the final player blackjack hand exceeds a target value, the blackjack base wager, including any supplemental amount added to the blackjack base wager from the war payout, may be collected and play may be terminated for that final player hand.

A final dealer blackjack hand is formed from the initial dealer blackjack hand by standing on the initial dealer blackjack hand or receiving at least one additional playing card dealt to the initial dealer blackjack hand. Again, the blackjack base wager is rewarded by issuing a blackjack payout and play is terminated when the sum of the playing cards in the final dealer blackjack hand exceeds a target value, that is, when the dealer hand busts.

The final player blackjack hand is compared to the final dealer blackjack hand and the target value when neither hand busts, that is, when the sum of the playing cards in the final dealer blackjack hand is less than or equal to the target value and the sum of the playing cards in the final player blackjack hand is less than or equal to the target value. The blackjack base wager is resolved by issuing a blackjack payout when the final player blackjack hand is closer to the target value than the final dealer blackjack hand is, or collecting the blackjack base wager, including any supplemental amount added to the blackjack base wager from the war payout, when the final dealer blackjack hand is closer to the target value than the final player blackjack hand is.

DESCRIPTION

Reference is now made to the figures wherein like parts are referred to by like numerals throughout. Referring to FIGS. 1-5, the present invention includes a method, device, and system for conducting a wagering game. The present invention may be conducted as a live table, utilizing a live dealer and physical or electronic playing cards. Additionally, the present invention may be conducted on an electronic device or system, such as an electronic table, electronic gaming machine, electronic table system, personal computer, tablet device, mobile device, or the like. Thus, it is contemplated that the present invention may be conducted as a live game, an electronic game, or a combination thereof and may be conducted using currency or chips or credits which may, or may not, have value. It is also noted that the present invention could be conducted substantially as an electronic game while still using physical playing cards, insofar as a playing card shuffler incorporating a random number generator may be used to randomize and deal playing cards. In this manner, the playing card shuffler functions as machine or device that randomly determines the outcome of the game through an electronic random number generator.

Figure 1:
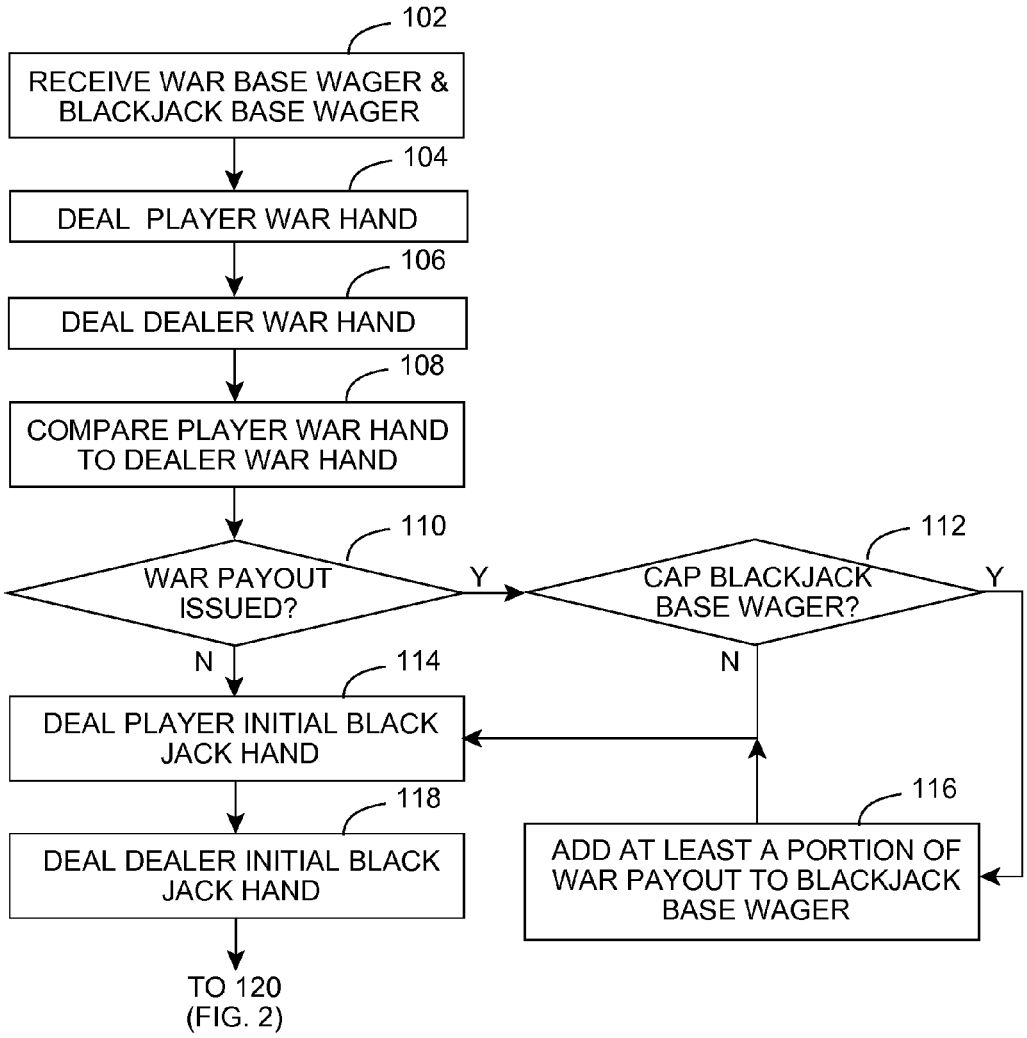
FIG. 1 is a flow chart of a method according to an embodiment of the present invention.
Figure 2:
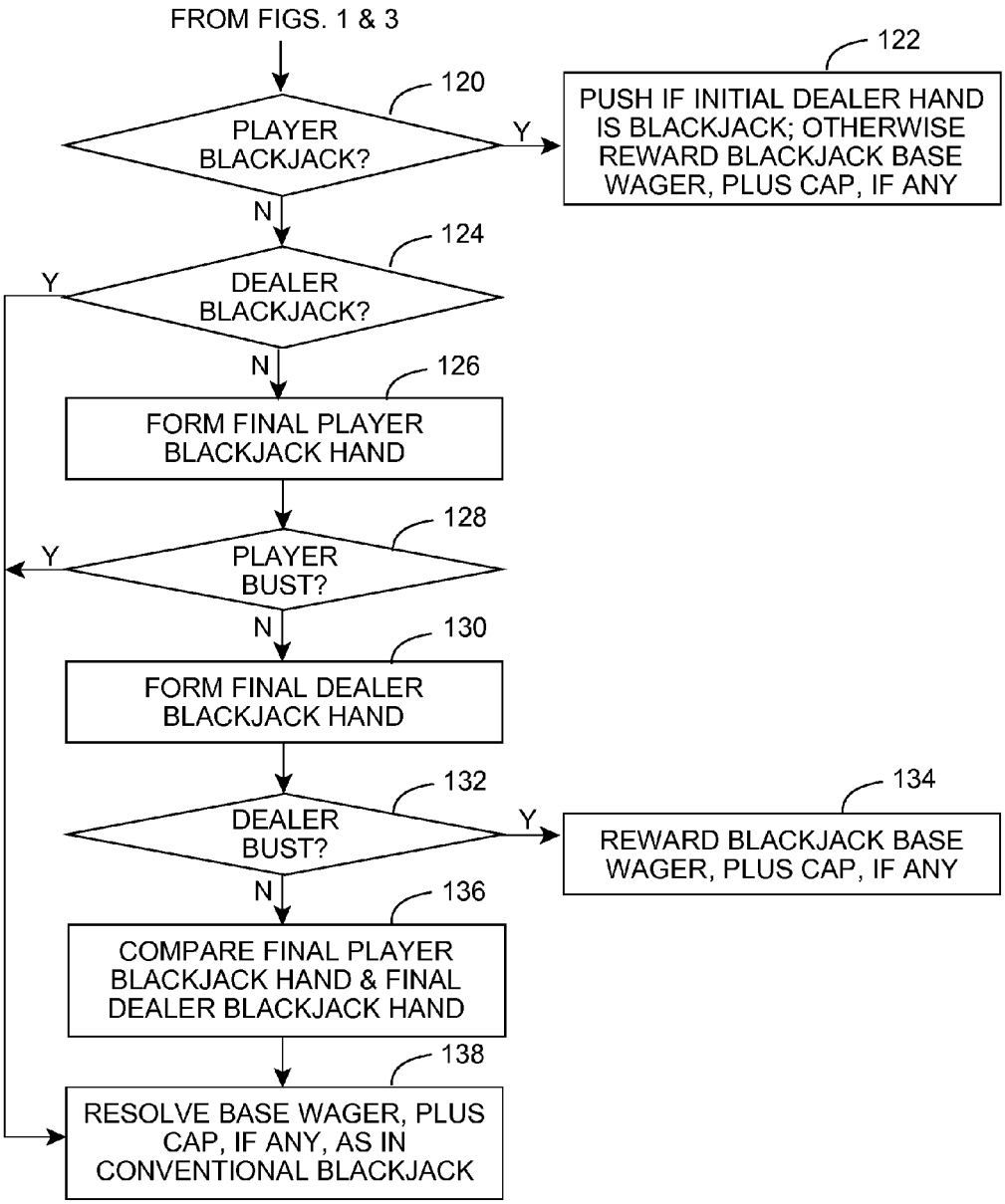
FIG. 2 is a flow chart of a method according to an embodiment of the present invention.
Figure 3:
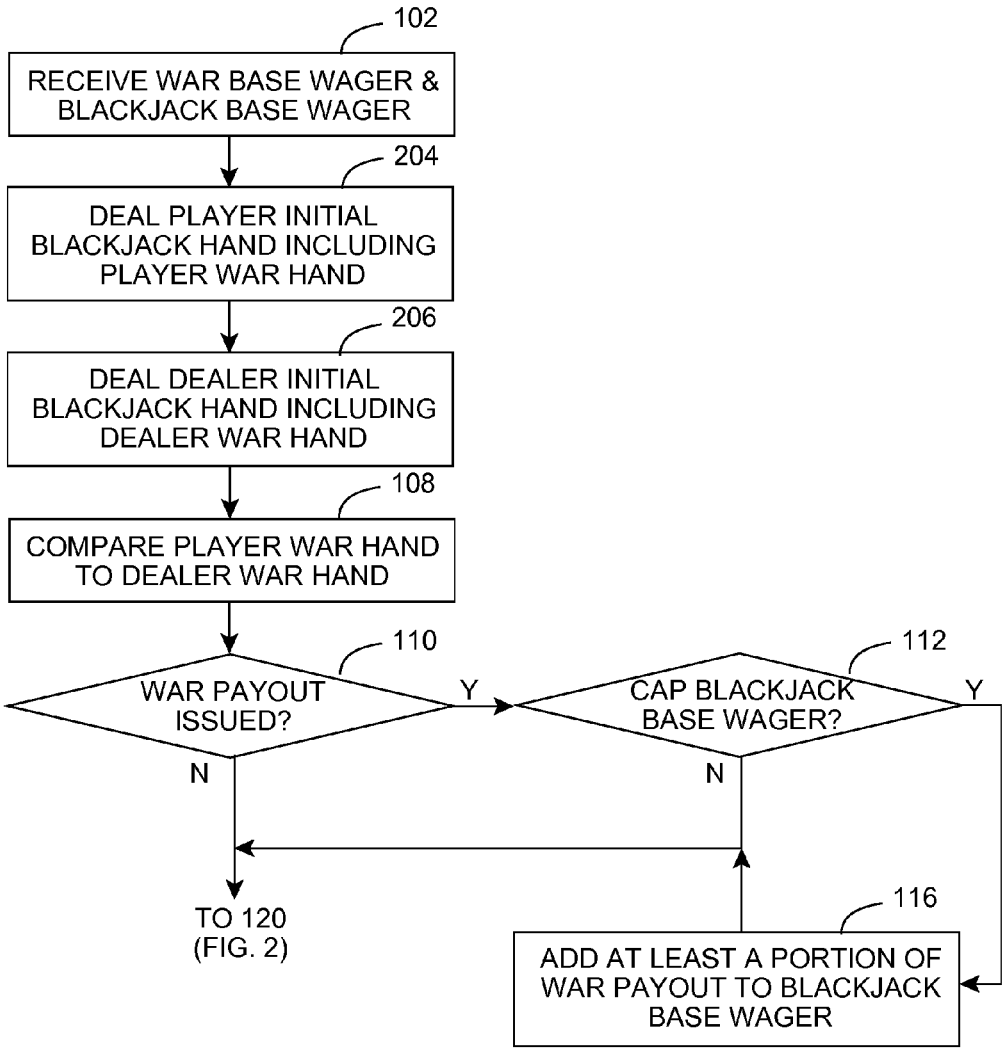
FIG. 3 is a flow chart of a method according to an embodiment of the present invention.
Figure 4:
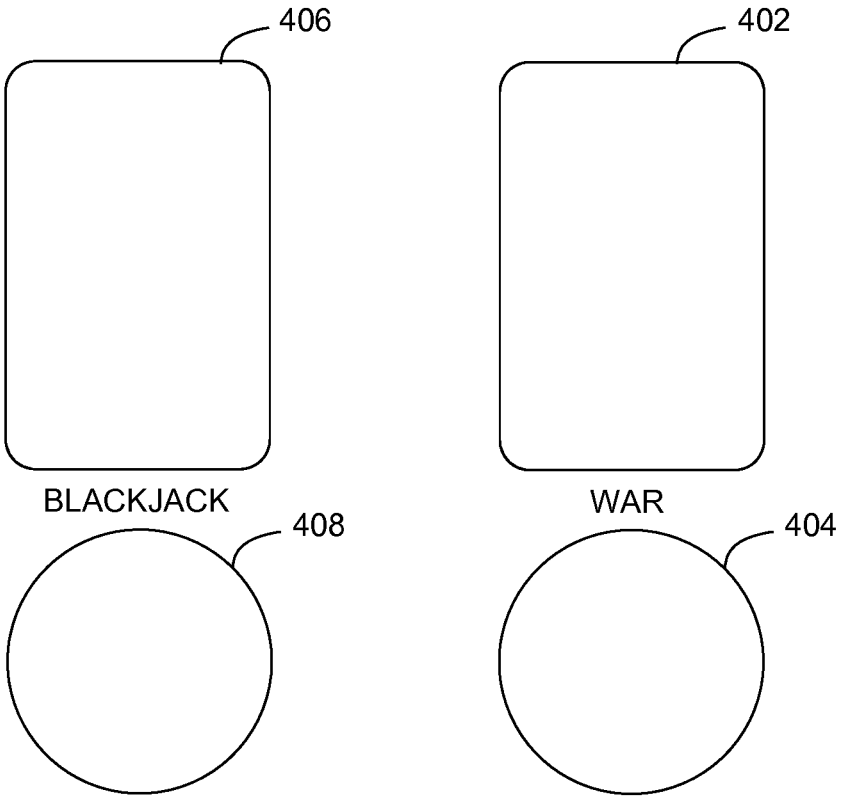
FIG. 4 is a top view of a player area of a table layout according to an embodiment of the present invention.

The present invention includes a method as illustrated in FIGS. 1-3. In an optional embodiment, the method is executed at a live table using physical or electronic playing cards. In another optional embodiment, the method is executed by a data processor in a system or device.

In one optional embodiment, a blackjack base wager and a war base wager are received 102. In an optional embodiment, the blackjack base wager and war base wager are received at the beginning of a game, e.g., prior to dealing or exposing any playing cards. The relative sizes of the blackjack base wager and war base wager may be determined by the operator. For example, the blackjack base wager and war base wager may be required to be the same size. In alternate optional embodiments, the blackjack base wager and war base wager may have any other proportional relationship. For example, in one such optional embodiment, the maximum war base wager may be twice the maximum blackjack wager (or vice versa, in other optional embodiments). In yet another optional embodiment, one or both of the war base wager and blackjack base wager may be unlimited. It is also contemplated that the war base wager and blackjack base wager may be received in a form representative of real money or non-monetary credits. That is, the present invention may include an entertainment version in which wagers and payouts are in the form of non-monetary credits that do not represent real money but rather only represent a measure of play of the game. Such non-monetary credits may be free or may be purchased, but cannot be cashed out for real money. It is contemplated, however, that such non-monetary credits may be traded for prizes, accumulated with non-monetary credits for tournament purposes, or serve any other purpose. The present invention may also include a gambling version in which wagers and payouts are in the form of real money, or are exchangeable for real money.

A method according to an embodiment of the present invention may be conducted using conventional playing cards. It is contemplated that the conventional playing cards may be constituted into any deck constitution, including a conventional fifty-two card poker deck, a truncated deck (such as a Spanish deck), a supplemented deck (such as a conventional poker deck with one or more Jokers added), or any other deck constitution. Additionally, it is contemplated that a method according to the present invention may be conducted using a single deck or multiple decks, and that any quantity of games may be conducted between randomization (e.g., shuffling) of the playing card inventory, including a continuous shuffle.

A player war hand is dealt 104. In an optional embodiment, the player war hand includes a single playing card (or electronic representation thereof) dealt face-up. However, in alternate optional embodiments, it is contemplated that the player war hand could consist of any quantity of playing cards that are dealt face-up or face-down.

A dealer war hand is dealt 106. Again, in an optional embodiment, the dealer war hand includes a single playing card (or electronic representation thereof) dealt face-up. However, in alternate optional embodiments, it is contemplated that the dealer war hand could consist of any quantity of playing cards that are dealt face-up or face-down. The phrase "dealer war hand" should not be interpreted as being limited to a house dealer insofar as the recipient of a "dealer war hand" could be a house dealer, computer-controlled dealer, player-banker, banker, or the like. That is, the "dealer war hand" is dealt to the entity which banks the wagers, i.e., pays winning wagers and collects losing wagers.

As illustrated in FIG. 1, a war portion of a game may be completed prior to dealing any additional playing cards to an initial player blackjack hand and/or an initial dealer blackjack hand. That is, in the example of FIG. 1, the steps of dealing a player war hand and a dealer war hand may be separated from the steps of dealing an initial player blackjack hand and an initial dealer blackjack hand. In the example embodiment of FIG. 1, the initial player blackjack hand may include the player war hand. That is, in one example, an initial player blackjack hand includes two playing cards. One of the playing cards of the initial player blackjack hand is dealt 104 first and is designated the player war hand. The second playing card of the initial player blackjack hand is dealt 114 after the resolution of the war base wager, and the combination of the two playing cards constitutes the initial player blackjack hand. Thus, in one such example, the playing card 8♢, designated the player war hand, may be dealt. After resolution of the war base wager, an additional playing card J♤ may be dealt, such that the initial player blackjack hand consists of the combination of playing cards J♤ 8♢. In another example according to the optional embodiment of FIG. 1, the player war hand may be dealt 104, and the initial player blackjack hand may be dealt 114 separate and independent from the player war hand without retaining any of the playing cards from the player war hand for inclusion in the initial player blackjack hand. Thus, in one such example, the playing card A♡ may be dealt to a player war hand, which is not carried over to the initial player blackjack hand, but rather two previously undealt playing cards are dealt to the initial player blackjack hand.

Similarly, the initial dealer blackjack hand may include the dealer war hand. That is, in one example, an initial dealer blackjack hand includes two playing cards, with one playing card dealt 106 to a dealer war hand, and a second playing card dealt 118 to be combined with the playing card of the dealer war hand to form a two-card initial dealer blackjack hand. In such an optional embodiment, the card dealt to the dealer war hand would function as the exposed card of the two-card initial dealer blackjack hand, i.e., the second playing card dealt to be combined with the dealer war hand would be dealt face-down or unexposed. Alternatively, the dealer war hand may be dealt separate and independent from the initial dealer blackjack hand without carrying over any playing cards from the dealer war hand for inclusion in the initial dealer blackjack hand. In such an optional embodiment, exposing one card of the initial dealer blackjack hand may occur when the initial dealer blackjack hand is dealt, or may be delayed until after the war base wager is resolved and a decision to cap the blackjack base wager is received (as discussed in greater detail below). It is contemplated that the player hands may be dealt using the same procedure as the dealer hand. Alternatively, the player hands may be dealt differently from the dealer hands, e.g., the initial player blackjack hand may include the player war hand whereas the initial dealer blackjack hand excludes the dealer war hand, or vice versa.

In another optional embodiment, illustrated in FIG. 3, an initial player blackjack hand is dealt 204, which includes a player war hand. Likewise, an initial dealer blackjack hand is dealt 206, which includes a dealer war hand. For example, in an optional embodiment two playing cards are dealt, with one playing card being designated the player war hand, and the combination of the two playing cards constituting the initial player blackjack hand. In essence, the optional embodiment of FIG. 3 includes dealing both the player war hand and initial player blackjack hand prior to resolving the war base wager, whereas the optional embodiment of FIG. 1 includes dealing only the player war hand prior to resolving the war base wager. This distinction is discussed in greater detail below. It is noted that the designation of the player war hand may be determined by chance (e.g., the first, or second, playing card dealt to the initial player blackjack hand is designated the player war hand), by the player (e.g., the player selects a playing card from the initial player blackjack hand to be the player war hand), or by house rules (e.g., the higher or lower playing card from the initial player blackjack hand is designated the player war hand).

Referring generally to FIGS. 1 and 3, the player war hand is compared 108 to the dealer war hand. Using a predetermined ranking system, a determination is made whether to issue 110 a war payout based on the war base wager. In one optional embodiment, the war payout is even money based on the war base wager.

In one optional embodiment, the determination of whether to issue a war payout is made by issuing a war payout if the player war hand outranks the dealer war hand, and collecting the war base wager if the dealer war hand outranks the player war hand. It is contemplated that the rankings may be determined by the ascending values of the playing cards in the player war hand and dealer war hand, e.g., a King outranks cards having a value of Queen or lower. In this regard, it is noted that in an optional embodiment utilizing conventional playing cards, Ace may be treated as the highest ranking playing card or the lowest ranking playing card, depending on the optional embodiment. Additionally, it is contemplated that ties may be handled in any fashion, including being resolved in favor of the dealer war hand (i.e., dealer takes ties), being resolved in favor of the player war hand (i.e., player takes ties), being resolved as a push, or being resolved based on a tiebreaker. It is contemplated that an embodiment employing a tiebreaker may use any procedure to break the tie, including dealing additional playing cards to a player war hand and/or dealer war hand. In the optional embodiment illustrated in FIGS. 1 and 3, Ace is the lowest ranking playing card such that the playing cards are, in ascending order, Ace, 2, 3, 4, 5, 6, 7, 8, 9, 10, Jack, Queen, and King, and all ties are resolved in favor of the dealer war hand.

In one optional embodiment, the war payout, if any, is issued to the player. In another optional embodiment, an election is received whether to issue the war payout, if any, to the player or add at least a portion of the war payout, if any, to the blackjack base wager. In yet another optional embodiment, the war payout is automatically added to the blackjack base wager, i.e., no election is received to cap the blackjack base wager.

In the optional embodiments illustrated in FIGS. 1 and 3, it is contemplated that an election is received 112 from a player whether to supplement the blackjack base wager with the winnings from the war portion of the game. In the event that a player elects to cap the blackjack base wager, at least a portion of the war payout is added 116 to the blackjack base wager. As alluded to above, it is contemplated that the timing of the election to cap the blackjack base wager with the war payout, if any, may vary depending on the embodiment. In one optional embodiment, the election to cap the blackjack base wager with all, or a portion of, the war payout may occur prior to exposure of a card of the initial dealer blackjack hand or dealing of the initial player blackjack hand. In such an optional embodiment, no information about the player or dealer blackjack hands would be known when the election is received. In another optional embodiment, the election to cap the blackjack base wager may occur after the initial player blackjack hand (or a portion thereof) is dealt and exposed, but before any playing cards of the initial dealer blackjack hand are exposed (or dealt). In yet another optional embodiment, the election to cap the blackjack base wager may occur after exposure of one playing card of the initial dealer blackjack hand is exposed, but before the initial player blackjack hand is dealt. In yet another optional embodiment, the election to cap the blackjack base wager may occur after exposure of one playing card of the initial dealer blackjack hand is exposed and the initial player blackjack hand (or a portion thereof) is dealt and exposed. In the latter optional embodiment, for example, a face-up card may be dealt to the player war hand and a face-up card may be dealt to be combined with the player war hand to form the initial player blackjack hand. Similarly, a face-up card may be dealt to the dealer war hand and a face-down card may be dealt to be combined with the dealer war hand to form the initial dealer blackjack hand. In this manner, the election whether to cap a blackjack base wager occurs with knowledge of the complete initial player blackjack hand and one of the two playing cards of the initial dealer blackjack hand. As discussed above, alternate optional embodiments would require the decision to cap a blackjack base wager to be made with less information about the initial player blackjack hand and/or the initial dealer blackjack hand.

It is contemplated that house rules may dictate whether an election to cap a blackjack base wager applies to the entire war payout or only a portion of a war payout. That is, in one optional embodiment, an election to cap, i.e., supplement, the blackjack base wager will result in adding a fixed amount of any war payout to the blackjack base wager. For example, in one optional embodiment, an election to cap the blackjack base wager with the war payout results in the entire war payout being added to the blackjack base wager. It is noted that other examples may include embodiments in which an election to cap the blackjack base wager results in a fixed portion (e.g., half) of the war payout being added to the blackjack wager.

In another optional embodiment, the election may include both whether to cap the blackjack base wager and the quantity of the war payout that caps the blackjack base wager. Thus, in one such example, a player may elect to cap the blackjack base wager with any player-selected amount of the war payout. For example, a player may elect to cap the blackjack base wager with ten percent of the war payout and remove the remainder of the war payout to the player's bankroll.

In one optional embodiment, a subsequent stage of the game is conducted to resolve the blackjack base wager, including any supplement from a war payout. This stage of the game includes an initial player blackjack hand. In one optional embodiment illustrated in FIG. 1, an initial player blackjack hand is dealt 114 after the decision to cap the blackjack base wager is received 112. As noted above, the step of dealing an initial player blackjack hand in the embodiment of FIG. 1 may include dealing a second playing card which is used in combination with the player war hand to form an initial player blackjack hand. Alternatively, the step of dealing an initial player blackjack hand in the embodiment of FIG. 1 may include removing the player war hand from play and dealing an initial player blackjack hand that is independent of the player war hand.

In the optional embodiment of FIG. 3, an initial player blackjack hand is dealt 204 prior to the decision to cap the blackjack base wager being received 112. More specifically, in the optional embodiment of FIG. 3, the initial player blackjack hand is dealt 204 to include the player war hand. However, it is contemplated that in alternate optional embodiments, the initial player blackjack hand dealt at the commencement of the game may be separate and independent of the player war hand dealt at the commencement of the game.

Similarly, an initial dealer blackjack hand is dealt 206. As noted above, the step of dealing an initial dealer blackjack hand in the embodiment of FIG. 1 may include dealing a second playing card which is used in combination with the dealer war hand to form an initial dealer blackjack hand. Alternatively, the step of dealing an initial dealer blackjack hand in the embodiment of FIG. 1 may include removing the dealer war hand from play and dealing an initial dealer blackjack hand that is independent of the dealer war hand. In the optional embodiment of FIG. 3, the initial dealer blackjack hand is dealt 206 to include the dealer war hand. However, it is contemplated that in alternate optional embodiments, the initial dealer blackjack hand dealt at the commencement of the game may be separate and independent of the dealer war hand dealt at the commencement of the game.

In one optional embodiment, a conventional blackjack game is conducted after resolving the war base wager. For example, referring generally to FIG. 2, in one optional embodiment, a determination is made 120 whether the initial player blackjack hand includes a blackjack, i.e., a two-card hand with a sum equal to a target value of twenty-one. In determining the sum of the values of the playing cards in a hand, each numbered playing card has a value equal to its face value, Jack, Queen, and King have a value equal to ten, and Ace has a value of one or eleven, as determined by the other playing cards in the hand. Thus, a blackjack holding, also referred to as a "twenty-one" or a "natural," is a two-card hand containing an Ace and a ten-value playing card. If the initial player blackjack hand is a blackjack, the blackjack base wager, including any cap from the war payout, if any, may be immediately resolved, with a blackjack payout issued 122 if the initial dealer blackjack hand is not a blackjack. Optionally, a blackjack payout for an initial player blackjack hand containing a blackjack is greater than even money, e.g., 3:2 or 6:5, depending on the optional embodiment.

In an optional embodiment, a push occurs (i.e., the blackjack base wager including any cap from the war payout, if any, is returned) if the initial player blackjack hand and the initial dealer blackjack hand both contain a blackjack. In an alternate optional embodiment, situations in which both the initial player blackjack hand and initial dealer blackjack hand both contain a blackjack may be resolved in favor of the house, i.e., dealer wins ties or in favor of the player, i.e., player wins ties. In further optional embodiments, ties may be broken using a predefined tie-breaking procedure.

If the initial player blackjack hand is not a blackjack, a determination 124 is made whether the initial dealer blackjack hand contains a blackjack, e.g. a two-card hand containing an Ace and a ten-value playing card. In an optional embodiment, if the initial dealer hand is a blackjack, the war base wager including any cap from the war payout, if any, may be collected for each initial player blackjack hand that is not also a blackjack. Play may be terminated for those players whose blackjack base wagers (including any cap) were collected. It is contemplated that, in an optional embodiment, an insurance wager may be offered when an exposed playing card of the initial dealer blackjack hand is an Ace. In an optional embodiment, such an insurance wager may operate in a conventional manner, with the insurance wager paid and the blackjack base wager (including any cap) collected if the initial dealer blackjack hand contains a blackjack.

If the initial dealer blackjack hand does not include a blackjack, a final player blackjack hand is formed 126 for each initial player blackjack hand not containing a blackjack. In an optional embodiment, final player blackjack hands are formed using the options available in conventional blackjack. For example, the options of hitting (i.e., receiving an additional playing card to the player hand), standing (i.e., ceasing to add playing cards to the player hand and designating the then-existing player hand as the final player blackjack hand), splitting a pair (i.e., placing an additional wager to form an additional initial player blackjack hand with each member of the pair constituting the basis for each initial player blackjack hand in combination with a newly dealt playing card), and doubling down (i.e., placing an additional blackjack wager to receive a single additional playing card to the player hand). It is contemplated that these options may be conducted in a conventional manner, or may be limited in some fashion to accommodate a desired house edge in the blackjack portion of the game. For example, the quantity of times a player may split, the player hands eligible for doubling down, whether a player may double down after splitting a hand, or other aspects of these options, may be limited in various optional embodiments.

In an optional embodiment, additional options, which are less common in conventional blackjack, such as surrendering a player hand, may be offered as well. It should also be noted that side action (e.g., side bets, bonus bets, or the like) may be offered along with the blackjack base wager in various optional embodiments.

If, in the course of forming a final player blackjack hand, the sum of the values of the playing cards in the player hand exceeds the target value of twenty-one, the player hand is deemed to "bust." For example, if a player hand contains playing cards with a sum of thirteen, and the player hand hits and obtains a ten-value playing card, that player hand is deemed to "bust." When a player hand busts 128, the blackjack base wager including any cap may be resolved 138 in a conventional manner with collection of the blackjack base wager including any cap. Further play in the game is terminated for any player hand that busts.

After each initial player blackjack hand is formed 126 into at least one final blackjack hand (keeping in mind that where splitting is permitted, an initial player blackjack hand may form multiple final player blackjack hands), the initial dealer blackjack hand is formed 130 into a final dealer blackjack hand. In an optional embodiment, the formation of a final dealer blackjack hand is determined according to house rules, insofar as there exists no discretion in the formation of the final dealer blackjack hand. For example, in conventional blackjack, a common house rule is that the dealer hand must hit until the sum of the values of the playing cards in the dealer hand greater than, or equal to, seventeen. In a further optional embodiment, a dealer hand may be required to hit when the sum of the values of the playing cards in the dealer hand equal seventeen when any Ace within the dealer hand is counted as eleven. Such a rule is often referred to as a "dealer must hit soft 17" rule.

If, in the course of the final dealer blackjack hand, the sum of the values of the playing cards in the dealer hand exceeds the target value of twenty-one, the dealer hand is deemed to "bust." When a dealer hand busts 132, the blackjack base wager including any cap may be resolved in a conventional manner by issuing 134 a reward based on the blackjack base wager including any cap. In an optional embodiment, such a blackjack payout may be even money based on the blackjack base wager including any cap.

When neither the dealer hand nor the player bust, the final dealer blackjack hand and final player blackjack hand are compared 136 and the blackjack base wager, including any cap, is resolved 138 in a conventional manner. More specifically, the sum of the values of the playing cards in the final player blackjack hand is compared to the sum of the values of the playing cards in the final dealer blackjack hand and the target value of twenty-one. If the final player blackjack hand sum is closer to twenty-one than the final dealer blackjack hand sum is, a blackjack payout is issued based on the blackjack base wager including any cap. In an optional embodiment, the blackjack payout is even money. Conversely, if the final dealer blackjack hand sum is closer to twenty-one than the final player blackjack hand sum is, the blackjack base wager, including any cap, is collected, i.e., lost. Ties may be resolved in any manner. For example, in one optional embodiment, ties are resolved as a push and the blackjack base wager, including any cap, is returned. In alternate optional embodiments, ties may be resolved in favor of the house, i.e., dealer wins ties, resolved in favor of the player, i.e., player wins ties, or broken using a predetermined tiebreaker procedure.

In use, a method according to an embodiment of the present invention may be carried out on a live table. In one such optional embodiment, a table layout may include a player area, such as that illustrated in FIG. 4. In the optional embodiment illustrated in FIG. 4, a player area includes a war base wager area 404 and a blackjack base wager area 408. In an optional embodiment, a war base wager area 404 receives the war base wager and the blackjack base wager area 408 receives the blackjack base wager. The wager amounts may be designated in any manner, including as currency, coins, gaming chips or gaming checks, credits, markers, or the like. In such an optional embodiment, wagers may be received when a wager amount is placed into the corresponding wager area. Similarly, payouts may be issued by placing a payout amount adjacent to the wager in or near the corresponding wager area. In an optional embodiment, a blackjack base wager is "capped" with the war payout (or a portion thereof) by placing the war payout (or a portion thereof) into the blackjack base wager area 408 adjacent or on the blackjack base wager. Optionally, the cap amount is placed into the blackjack base wager area 408 by a house dealer, player-banker, or the like such that the player does not handle the cap amount. For example, in one optional embodiment, the election to cap the blackjack base wager is simply indicated to a house dealer, player-banker, or the like and the war payout (or a portion thereof) is issued directly into the blackjack base wager area 408 by the house dealer, player-banker, or the like.

A player area may also include a player war hand area 402 and a player blackjack hand area 406. In an optional embodiment in which the initial player blackjack hand does not include the player war hand, a single card may be dealt to the player war hand area 402 and two cards (constituting the initial player blackjack hand) may be dealt to the player blackjack hand area 406. In an optional embodiment in which the initial player blackjack hand includes the player war hand, a single card may be dealt to the player war hand area 402 and a single card may be dealt to the player blackjack hand area 406, such that the single card in the player war hand area 402 constitutes the player war hand, and the combination of the single card in the player war hand area 402 and the single card in the player blackjack hand area 406 constitute the initial player blackjack hand.

Figure 5:
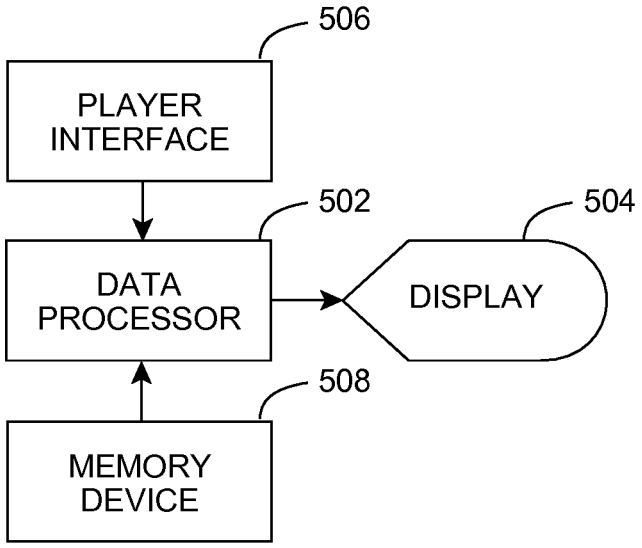
FIG. 5 is a block diagram of a device according to an embodiment of the present invention.

As illustrated in FIG. 5, a method according to the present invention may also be conducted on an electronic device. The form of the electronic device may vary depending on the embodiment. For example, the electronic device may include an electronic gaming table, electronic table system, electronic gaming machine, slot machine, video game machine, gaming console, mobile phone, tablet device, personal computer, kiosk, or the like. In one such example, an electronic device could include a data processor 502. The data processor 502 may take any form, including a conventional computer processor. The data processor 502 is in communication with a display 504. The data processor 502 may communicate directly or indirectly, such as through a video controller, with the display 504. The display 504 could take any form, such as a cathode ray tube ("CRT") monitor, liquid crystal display ("LCD"), light emitting diode ("LED") screen, plasma display, or any other form of display.

A player interface 506 also communicates with the data processor 502. The player interface 506 may include an input device to communicate input from a player to the data processor 502. For example, the player interface 506 may include a button panel, mouse, keyboard, keypad, pointer, or the like. In an optional embodiment, the player interface 506 may be integrated with the display 504 into a touch screen display which is configured to receive input and display output.

A memory device 508 communicates with the data processor 502. The memory device 508 may include optical data storage, magnetic data storage, electrical data storage, Flash data storage, or any other form of data storage. The memory device 508 stores graphics, sounds, and data files to conduct a method according to an embodiment of the present invention. Additionally, the memory device 508 stores program instructions executable by the data processor 502 to conduct a game according to an embodiment of the present invention.

For example, in one such optional embodiment, a blackjack base wager and a war base wager are received through the player interface 506. The receipt of the blackjack base wager and war base wager may occur through physical receipt of the wager amounts through the player interface 506, such as receiving currency through a bill acceptor, coins through a coin receiver, a ticket or voucher through a ticket reader, account information through a keypad or magnetic card reader, or the like. Alternatively, receipt of the blackjack base wager and war base wager may occur through receipt of input designating wager amounts to be allocated from a stored register of game credits.

The data processor 502 deals a player war hand and displays the player war hand at the display 504. In an optional embodiment, the data processor 502 executes software or firmware to act as a random number generator, or cooperates with a software, firmware, or hardware random number generator to generate a random number. The memory device 508 stores a map correlating random numbers to playing cards or playing card combinations.

As discussed above, an initial player blackjack hand may also be dealt by the data processor 502 and displayed at the display 504 at the same time, with the initial player war hand incorporating or excluding the player war hand, depending on the optional embodiment. Alternatively, the initial player blackjack hand may be dealt by the data processor 502 and displayed at the display 504 after resolution of the war base wager. In yet another optional embodiment, an initial player blackjack hand may be dealt by the data processor 502 along with the player war hand (with the initial player blackjack hand incorporating or excluding the player war hand) but without displaying the initial player blackjack hand at the display 504 until after resolution of the war base wager.

Likewise, a dealer war hand is dealt by the data processor 502. Again, the initial dealer blackjack hand may be dealt at the same time, or after the resolution of the war base wager. In the optional embodiment in which the initial dealer blackjack hand incorporates the dealer war hand, the playing card of the dealer war hand may function as the exposed (i.e., face-up) playing card of the initial dealer blackjack hand. In the optional embodiment in which the initial dealer blackjack hand and dealer war hand are separate, the face-up playing card of the initial dealer blackjack hand may be exposed at the display 504 before or after resolution of the war wager and a decision whether to cap the blackjack base wager with any war payout is received. For example, in one optional embodiment, a face-up playing card is dealt to the player war hand along with a face-up playing card to be combined with the player war hand to form the initial player blackjack hand. Similarly, a face-up playing card is dealt to the dealer war hand along with a face-down playing card to be combined with the dealer war hand to form the initial dealer blackjack hand. Thus, in such an example, the display 504 displays three face-up playing cards and one face-down playing card after the war hands and initial blackjack hands are dealt.

The war base wager is resolved by the data processor 502 comparing the player war hand to the dealer war hand and determining whether the player war hand outranks the dealer war hand. In an optional embodiment, a war payout is issued if the player war hand outranks the dealer war hand and the war base wager is collected if the dealer war hand ties or outranks the player war hand. In an optional embodiment, any war payout is displayed at the display 504.

An election is received through a player interface 506 whether to cap, i.e., supplement, the blackjack base wager. As discussed above, some or all (depending on the optional embodiment) of the war payout may be added to the blackjack base wager prior to conducting a blackjack portion of a game. In one such optional embodiment, a prompt may be displayed at the display 504 when a war payout is issued to prompt input of an election whether to cap the blackjack wager. The election may then be input through the player interface 506. In an optional embodiment, the amount of the cap may be predetermined (such as the entire war payout, half the war payout, or other predetermined amount) or may be selectable by inputting an amount through the player interface 506.

The blackjack portion of the game includes dealing by the data processor of an initial player blackjack hand, if it has not already been dealt. Likewise, a portion of the initial dealer blackjack hand is displayed at the display 504, if it has not already been displayed. A blackjack payout may be issued by the data processor 502 based on the blackjack base wager including any cap if the initial player blackjack hand is a blackjack, i.e., a two-card hand containing an Ace and a ten-value playing card, and the initial dealer blackjack hand is not a blackjack. In an optional embodiment, the blackjack payout when the initial player blackjack hand is a blackjack is greater than even money, e.g., 3:2, 6:5, or the like. Conversely, the blackjack base wager, including any cap, is collected by the data processor 502 if the initial dealer blackjack hand is a blackjack and the initial player blackjack hand is not a blackjack. In one optional embodiment, a push occurs and the blackjack base wager, including any cap, is returned by the data processor 502, if both the initial player blackjack hand and the initial dealer blackjack hand are blackjacks. It is contemplated that in alternate optional embodiments, tied hands may be resolved in favor of the house or player, or the tie may be broken by the data processor 502. As discussed above, a conventional insurance option may be displayed at the display 504 and elected through a player interface 506 in the event that the exposed card of the initial dealer blackjack hand is an Ace.

If neither the initial player blackjack hand nor the initial dealer blackjack hand contains a blackjack, a final player blackjack hand is formed. In an optional embodiment, elections are received through a player interface 506 to form a final player blackjack hand. As discussed above, the conventional options of hitting or standing may be input through a player interface 506. Additionally, options such as splitting, doubling down, and/or surrender may also be displayed at the display 504 and received through a player interface 506, depending on the optional embodiment and the content of the player blackjack hand. As above, in the event that the player blackjack hand busts in the course of forming the final player blackjack hand, the blackjack base wager plus any cap may be collected by the data processor 502 and play may be terminated.

After forming a final player blackjack hand, the data processor 502 forms a final dealer blackjack hand. In an optional embodiment, a final dealer blackjack hand is formed according to predetermined house rules as described above. If the dealer blackjack hand busts in the course of forming the final dealer blackjack hand, a blackjack payout (optionally, even money) is issued by the data processor 502 based on the blackjack base wager plus any cap and play is terminated.

If play has not been terminated due to a bust or a blackjack, the final player blackjack hand and final dealer blackjack hand are compared by the data processor 502 to the target value of twenty-one. A blackjack payout is issued by the data processor 502 based on the blackjack base wager plus any cap when the sum of the values of the playing cards in the final player blackjack hand is closer to the target value than the sum of the values of the playing cards in the final dealer blackjack hand is. Conversely, a blackjack base wager plus any cap is collected by the data processor 502 when the sum of the values of the playing cards in the final dealer blackjack hand is closer to the target value than the sum of the values of the playing cards in the final player blackjack hand is.

Any payouts may be dispensed via an output device associated with, or part of, the player interface 506. For example, an output device may take the form of a ticket printer, coin dispenser, card encoder, or the like. Additionally or alternatively, payouts may be added to a register of stored game credits or an electronic account.

While certain embodiments of the present invention have been shown and described it is to be understood that the present invention is subject to many modifications and changes without departing from the spirit and scope of the claims presented herein.

I claim:

1. A method for conducting a game utilizing an electronic device having a data processor in communication with a display, a player interface, and a memory device, wherein said memory device is configured to store electronic representations of playing cards and program instructions executable by said data processor to conduct steps comprising:

receiving a blackjack base wager and a war base wager through said player interface;

dealing a player war hand consisting of a single playing card by said data processor;

dealing a dealer war hand consisting of a single playing card by said data processor;

resolving said war base wager by said data processor by comparing said player war hand to said dealer war hand and issuing a war payout based on said war base wager when said player war hand outranks said dealer war hand;

receiving an election through said player interface to supplement said blackjack base wager with at least a portion of said war payout, if any, while said dealer war hand is exposed;

dealing an initial player blackjack hand by said data processor, wherein said initial player blackjack hand includes said player war hand;

dealing an initial dealer blackjack hand by said data processor, wherein said initial dealer blackjack hand includes said dealer war hand such that said step of receiving an election to supplement said blackjack base wager is received while said dealer war hand is exposed;

forming a final player blackjack hand from said initial player blackjack hand by standing on said initial player blackjack hand or receiving at least one additional playing card dealt to said initial player blackjack hand by said data processor, wherein if the sum of the playing cards in said final player blackjack hand exceeds a target value, said blackjack base wager, including any supplemental amount added to said blackjack base wager from said war payout, is collected by said data processor and play is terminated by said data processor for said final player hand;

forming a final dealer blackjack hand from said initial dealer blackjack hand by said data processor by standing on said initial dealer blackjack hand or receiving at least one additional playing card dealt to said initial dealer blackjack hand, wherein said blackjack base wager is rewarded by said data processor by issuing a blackjack payout and play is terminated by said data processor when the sum of the playing cards in said final dealer blackjack hand exceeds a target value;

comparing said final player blackjack hand to said final dealer blackjack hand and said target value by said data processor when the sum of the playing cards in said final dealer blackjack hand is less than or equal to said target value and the sum of the playing cards in said final player blackjack hand is less than or equal to said target value; and resolving said blackjack base wager by said data processor by issuing a blackjack payout when said final player blackjack hand is closer to said target value than said final dealer blackjack hand is, or collecting said blackjack base wager, including any supplemental amount added to said blackjack base wager from said war payout, when said final dealer blackjack hand is closer to said target value than said final player blackjack hand is.

2. The method of claim 1 wherein said step of receiving an election to supplement said blackjack base wager comprises supplementing said blackjack base wager with all of said war payout, if any.

3. The method of claim 1 wherein said step of receiving an election to supplement said blackjack base wager comprises supplementing said blackjack base wager with a predefined portion of said war payout, if any.

4. The method of claim 1 wherein said step of receiving an election to supplement said blackjack base wager comprises supplementing said blackjack base wager with a player-selected portion of said war payout, if any.

5. A device for conducting a game utilizing playing cards comprising:

a data processor;

a display in communication with said data processor;

a player interface in communication with said data processor; and a memory device in communication with said data processor, wherein said memory device is configured to store electronic representations of playing cards and program instructions executable by said data processor to conduct the steps of:

receiving a blackjack base wager and a war base wager through said player interface;

dealing a player war hand by said data processor consisting of a single playing card and displaying said player war hand at said display;

dealing a dealer war hand by said data processor consisting of a single playing card and displaying said dealer war hand at said display;

resolving said war base wager by said data processor comparing said player war hand to said dealer war hand and issuing a war payout based on said war base wager when said player war hand outranks said dealer war hand;

receiving an election through said player interface to supplement said blackjack base wager with at least a portion of said war payout, if any, while said dealer war hand is exposed at said display;

dealing an initial player blackjack hand by said data processor, wherein said initial player blackjack hand includes said player war hand;

dealing an initial dealer blackjack hand by said data processor, wherein said initial dealer blackjack hand includes said dealer war hand such that said step of receiving an election through said player interface to supplement said blackjack base wager is received while said dealer war hand is exposed at said display;

forming a final player blackjack hand from said initial player blackjack hand by receiving an election through said player interface to stand on said initial player blackjack hand or receive at least one additional playing card dealt to said initial player blackjack hand, wherein if the sum of the playing cards in said final player blackjack hand exceeds a target value, said blackjack base wager, including any supplemental amount added to said blackjack base wager from said war payout, is collected and play is terminated for said final player hand by said data processor;

forming a final dealer blackjack hand from said initial dealer blackjack hand by said data processor standing on said initial dealer blackjack hand or receiving at least one additional playing card dealt to said initial dealer blackjack hand, wherein said blackjack base wager is rewarded by issuing a blackjack payout and play is terminated by said data processor when the sum of the playing cards in said final dealer blackjack hand exceeds a target value;

comparing said final player blackjack hand to said final dealer blackjack hand and said target value by said data processor when the sum of the playing cards in said final dealer blackjack hand is less than or equal to said target value and the sum of the playing cards in said final player blackjack hand is less than or equal to said target value; and resolving said blackjack base wager by said data processor issuing a blackjack payout when said final player blackjack hand is closer to said target value than said final dealer blackjack hand is, or collecting said blackjack base wager, including any supplemental amount added to said blackjack base wager from said war payout, when said final dealer blackjack hand is closer to said target value than said final player blackjack hand is.

6. The device of claim 5 wherein said step of receiving an election to supplement said blackjack base wager comprises supplementing said blackjack base wager with all of said war payout, if any.

7. The device of claim 5 wherein said step of receiving an election to supplement said blackjack base wager comprises supplementing said blackjack base wager with a player-selected portion of said war payout, if any.

* * * * *